US011054784B2

(12) United States Patent
Tabuchi

(10) Patent No.: US 11,054,784 B2
(45) Date of Patent: Jul. 6, 2021

(54) RELAY CONVEYANCE DEVICE

(71) Applicant: KYOCERA Document Solutions Inc., Osaka (JP)

(72) Inventor: Hidehiro Tabuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 245 days.

(21) Appl. No.: 16/362,860

(22) Filed: Mar. 25, 2019

(65) Prior Publication Data

US 2019/0294099 A1 Sep. 26, 2019

(30) Foreign Application Priority Data

Mar. 26, 2018 (JP) ..... JP2018-057842

(51) Int. Cl.
*G03G 15/00* (2006.01)
*B65H 29/12* (2006.01)
*B65H 9/00* (2006.01)

(52) U.S. Cl.
CPC ..... *G03G 15/6555* (2013.01); *B65H 9/00* (2013.01); *B65H 29/125* (2013.01); *G03G 15/6538* (2013.01); *B65H 2301/33312* (2013.01); *B65H 2301/4452* (2013.01); *B65H 2513/53* (2013.01); *B65H 2557/652* (2013.01); *B65H 2601/121* (2013.01); *B65H 2801/06* (2013.01); *B65H 2801/27* (2013.01); *G03G 15/6582* (2013.01)

(58) Field of Classification Search
CPC ..... G03G 15/6555; B65H 2557/652; B65H 2301/4452; B65H 2601/121
See application file for complete search history.

(56) References Cited

U.S. PATENT DOCUMENTS 6,450,711 B1 * 9/2002 Conrow ..... B65H 15/00 400/582
8,253,958 B2 * 8/2012 Brougham ..... G06Q 10/06 358/1.15
8,401,455 B2 * 3/2013 Suh ..... B65H 29/60 399/382
2008/0030809 A1 * 2/2008 Itabashi ..... B65H 7/14 358/498

(Continued)

FOREIGN PATENT DOCUMENTS

JP 2009-086600 A 4/2009

*Primary Examiner* — Jennifer Bahls
(74) *Attorney, Agent, or Firm* — Studebaker & Brackett PC

(57) ABSTRACT

A relay conveyance device includes a relay conveyance path arranged between an image forming apparatus and a post processing device to convey a sheet from the image forming apparatus to the post processing device, two reversing units reversing a surface side and a back-face side of the sheet, and a control device controlling conveyance of the sheet on the relay conveyance path. The relay conveyance path includes two reverse paths respectively passing through the two reversing units, a branch section branching into the two reverse paths at an upstream side, and a confluence section joining the two reverse paths. The control device controls the branch and confluence sections to convey the sheet while alternately switching the two reverse paths, measures an interval time between the sheets passing through the confluence section, and controls conveyance of the sheet in the two reverse paths so as to uniformize the interval time.

4 Claims, 4 Drawing Sheets

(56) References Cited

U.S. PATENT DOCUMENTS

| | | | | |
|---|---|---|---|---|
| 2009/0092431 | A1 | 4/2009 | Saitsu | |
| 2010/0327519 | A1* | 12/2010 | Miyazawa | B65H 7/08 271/248 |
| 2013/0032990 | A1* | 2/2013 | Hattori | B65H 39/10 271/3.16 |

* cited by examiner

RELAY CONVEYANCE DEVICE

INCORPORATION BY REFERENCE

This application is based on and claims the benefit of priority from Japanese Patent application No. 2018-057842 filed on Mar. 26, 2018, the entire contents of which are incorporated herein by reference.

BACKGROUND

The present disclosure relates to a relay conveyance device conveying a sheet from an image forming apparatus to a post processing device.

Conventionally, a relay conveyance device is known to relay and convey a sheet from an image forming apparatus forming an image on the sheet to a post processing device carrying out post-process of the sheet on which the image is formed by the image forming apparatus.

For example, a conventional image forming system includes a first post processing device, a second post processing device, a first reversing unit, a second reversing unit and a central processing unit (CPU). The first post processing device carries out post-process of a sheet after image forming. The second post processing device carries out post-process of the sheet passed through the first post processing device. The first reversing unit conveys the sheet to the first post processing device and can reverse a surface side and a back-face side of the sheet. The second reversing unit conveys the sheet to the second post processing device and can reverse the surface side and the back-face side of the sheet. The CPU controls the first reversing unit and the second reversing unit on the basis of indication with respect to image forming.

The relay conveyance device includes the reversing unit reversing the surface side and the back-face side of the sheet, but because the reversing unit must make an interval between the sheets so that the sheet to be reversed does not interfere with the following sheet, the reversing unit cannot shorten the interval between the sheets. Therefore, the relay conveyance device is provided with a plurality of reverse paths respectively passing through a plurality of reversing units to convey the sheet one by one while alternately switching the plurality of reverse paths. Thereby, without shortening the interval between the sheets in each reverse path, it is possible to shorten the interval between the sheets before branching of the plurality of reverse paths and after joining of the plurality of reverse paths, and then, because conveyance speed of the sheet is heightened, to improve productivity.

In the above-mentioned relay conveyance device, it is necessary to equalize path lengths of the plurality of reverse paths and to synchronize reverse control of the plurality of reversing units, and then, to equalize the interval between the sheets in sheet continuous conveyance. However, due to wear and slip of a conveying roller by aging, a difference between conveyance speeds in the plurality of reverse paths occurs, and then, a difference between sheet arrival times at a joining destination common to the plurality of reverse paths may occur. Therefore, if the sheet is continuously conveyed, a different of the interval between the sheets may occur for each reverse path through which the sheet passes.

SUMMARY

In accordance with the present disclosure, a relay conveyance device includes a relay conveyance path, at least two reversing units, and a control device. The relay conveyance path is arranged between an image forming apparatus forming an image on a sheet and a post processing device carrying out post process to the sheet with the image formed by the image forming apparatus to convey the sheet from the image forming apparatus to the post processing device. The at least two reversing units reverse a surface side and a back-face side of the sheet. The control device controls conveyance of the sheet on the relay conveyance path. The relay conveyance path includes at least two reverse paths respectively passing through the at least two reversing units, a branch section branching into the at least two reverse paths at an upstream side, and a confluence section joining the at least two reverse paths. The control device controls the branch section and the confluence section to convey the sheet while alternately switching the at least two reverse paths, measures an interval time between the sheets passing through the confluence section, and controls conveyance of the sheet in the at least two reverse paths so as to uniformize the interval time.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

An image forming system 1 including a relay conveyance device 4 according to an embodiment of the present disclosure will be described. Hereinafter, for convenience of description, it will be described so that the front side of the relay conveyance device 4 is positioned at a near side on a paper sheet of FIG. 1. Arrows L, R, U and Lo in each of the drawings respectively indicate a left side, a right side, an upper side and a lower side of the relay conveyance device 4.

The image forming system 1 includes an image forming apparatus 2 imaging an image on a sheet, a post processing device 3 carrying out post-process of the sheet on which the image is formed by the image forming apparatus 2, and the relay conveyance device 4 relaying and conveying the sheet from the image forming apparatus 2 to the post processing device 3.

Figure 1:
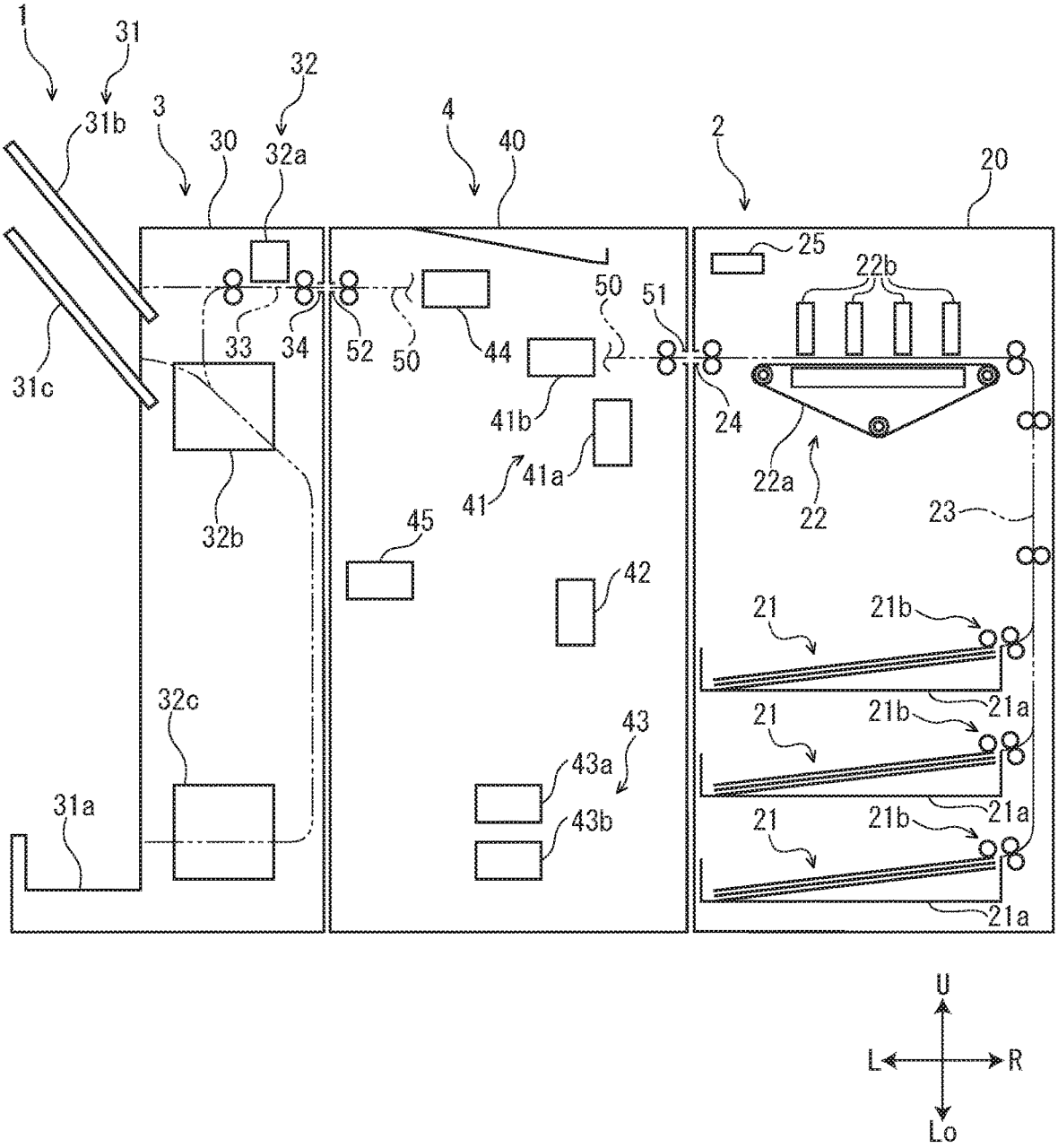
FIG. 1 is a sectional view schematically showing an image forming system including a relay conveyance device according to an embodiment of the present disclosure.

Structure of the image forming apparatus 2 will be described with reference to FIG. 1. The image forming apparatus 2 includes a box-shape apparatus body 20, a plurality of sheet feeding parts 21 housed in a lower part of the apparatus body 20, and an image forming part 22 housed in an upper part of the apparatus body 20. The image forming apparatus 2 is, for example, a printer, a multifunction peripheral, or the like.

Inside the apparatus body 20, an upstream side conveyance path 23 conveying the sheet is provided. At a downstream end of the upstream side conveyance path 23, an upstream side ejecting port 24 is provided. The upstream side ejecting port 24 is opened in an upper part of a left face of the apparatus body 20 (a lateral face at a side of the relay conveyance device 4).

The plurality of sheet feeding parts 21 are located at an upstream end of the upstream side conveyance path 23. The plurality of sheet feeding parts 21 are juxtaposed in upward and downward directions. Each sheet feeding part 21 includes a sheet feeding cartridge 21*a* storing the sheet, and a sheet feeding mechanism 21*b* arranged at a right upper side of the sheet feeding cartridge 21*a*. The sheet is made of, for example, paper, synthetic resin or cloth.

The image forming part 22 is arranged at a middle-stream part of the upstream side conveyance path 23. The image forming part 22 adopts an ink-jet manner. The image forming part 22 includes a conveyance belt 22*a*, and four recording heads 22*b* arranged above the conveyance belt 22*a*. The conveyance belt 22*a* is wound around a plurality of rollers and rotatably supported. The respective recording heads 22*b* are provided so as to eject inks of different colors.

In addition, the image forming apparatus 2 includes a first control device 25 generally controlling each component of the image forming apparatus 2. The first control device 25 is composed of a controller, such as a CPU, and storages, such as a ROM and a RAM. The controller controls each component connected to the first control device 25 on the basis of control programs and control data stored in the storages.

Figure 3:
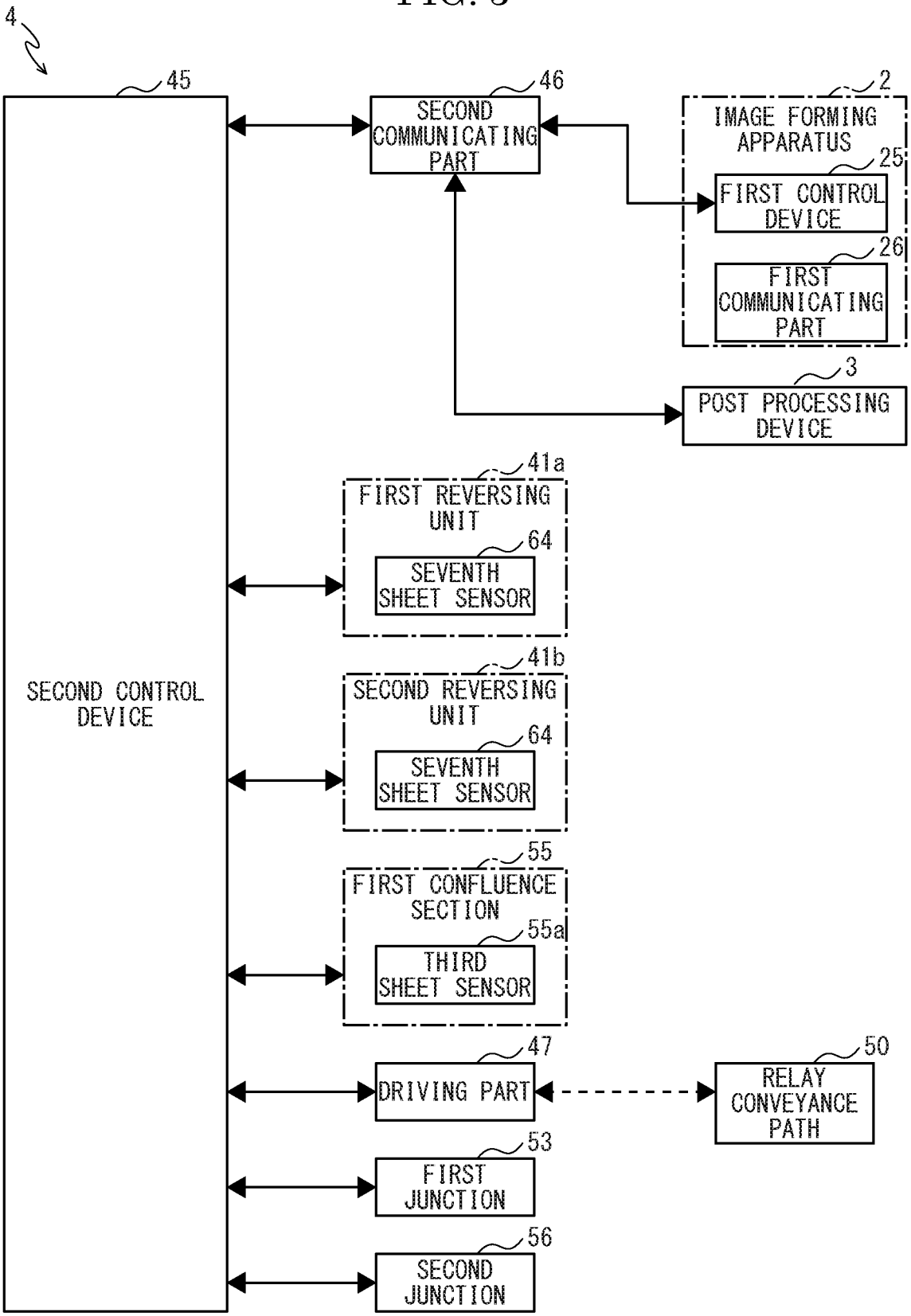
FIG. 3 is a block diagram showing structure of the relay conveyance device according to the embodiment of the present disclosure.

The first control device 25 is, as shown in FIG. 3, connected to a first communicating part 26, and the first communicating part 26 is communicably connected to the post processing device 3 and the relay conveyance device 4. The first control device 25 transmits sheet information to the relay conveyance device 4 via the first communicating part 26. For example, the sheet information indicates a size, a type and others of the sheet ejected from the upstream side ejecting port 24 to the relay conveyance device 4 after image forming.

Next, operation of the image forming apparatus 2 will be described. First, in each sheet feeding part 21, the sheet feeding mechanism 21*b* picks up the sheet from the sheet feeding cartridge 21*a* and feeds out the sheet to the upstream side conveyance path 23. The sheet is conveyed on the upstream conveyance path 23 to enter the image forming part 22. In the image forming part 22, the sheet is absorbed onto an upper face of the conveyance belt 22*a* and conveyed in accordance with rotation of the conveyance belt 22*a*. Each recording head 22*b* ejects the ink to the sheet absorbed on the upper face of the conveyance belt 22*a* from an upper side on the basis of the image data, thereby to form the image on the sheet. The sheet with the formed image is further conveyed on the upstream side conveyance path 23 and ejected via the upstream side ejecting port 24.

Structure of the post processing device 3 will be described with reference to FIG. 1. The post processing device 3 includes a casing 30, a plurality of ejection trays 31 (a first ejection tray 31*a*, a second ejection tray 31*b*, a third ejection tray 31*c*) protruded from a left face of the casing 30, and a plurality of post processing mechanisms 32 (a first post processing mechanism 32*a*, a second post processing mechanism 32*b*, a third post processing mechanism 32*c*) housed in the casing 30.

Inside the casing 30, a downstream side conveyance path 33 conveying the sheet is provided. At an upstream end of the downstream side conveyance path 33, a downstream side introducing port 34 is provided. The downstream side introducing port 34 is opened in an upper part of a right face of the casing 30 (a lateral face at a side of the relay conveyance device 4).

The plurality of post processing mechanisms 32 includes, for example, the first post processing mechanism 32*a* having a punching function, the second post processing mechanism 32*b* having a staple function, and the third post processing mechanism 32*c* having a sheet folding function.

Next, operation of the post processing device 3 will be described. When the sheet with the image formed by the image forming apparatus 2 is ejected from the relay conveyance device 4 to the post processing device 3, the sheet is introduced to the downstream side conveyance path 33 via the downstream side introducing port 34. The sheet is conveyed to the first post processing mechanism 32*a* and, if necessary, is subjected to punching process. The sheet passed through the first post processing mechanism 32*a* is ejected to the second ejection tray 31*b* or is conveyed to second post processing mechanism 32*b*. The sheet conveyed to second post processing mechanism 32*b* and, if necessary, is subjected to staple process. The sheet passed through the second post processing mechanism 32*b* is ejected to the third ejection tray 31*c* or is conveyed to third post processing mechanism 32*c*. The sheet conveyed to third post processing mechanism 32*c* and, if necessary, is subjected to sheet folding process. The sheet passed through the third post processing mechanism 32*c* is ejected to the first ejection tray 31*a*.

Figure 2:
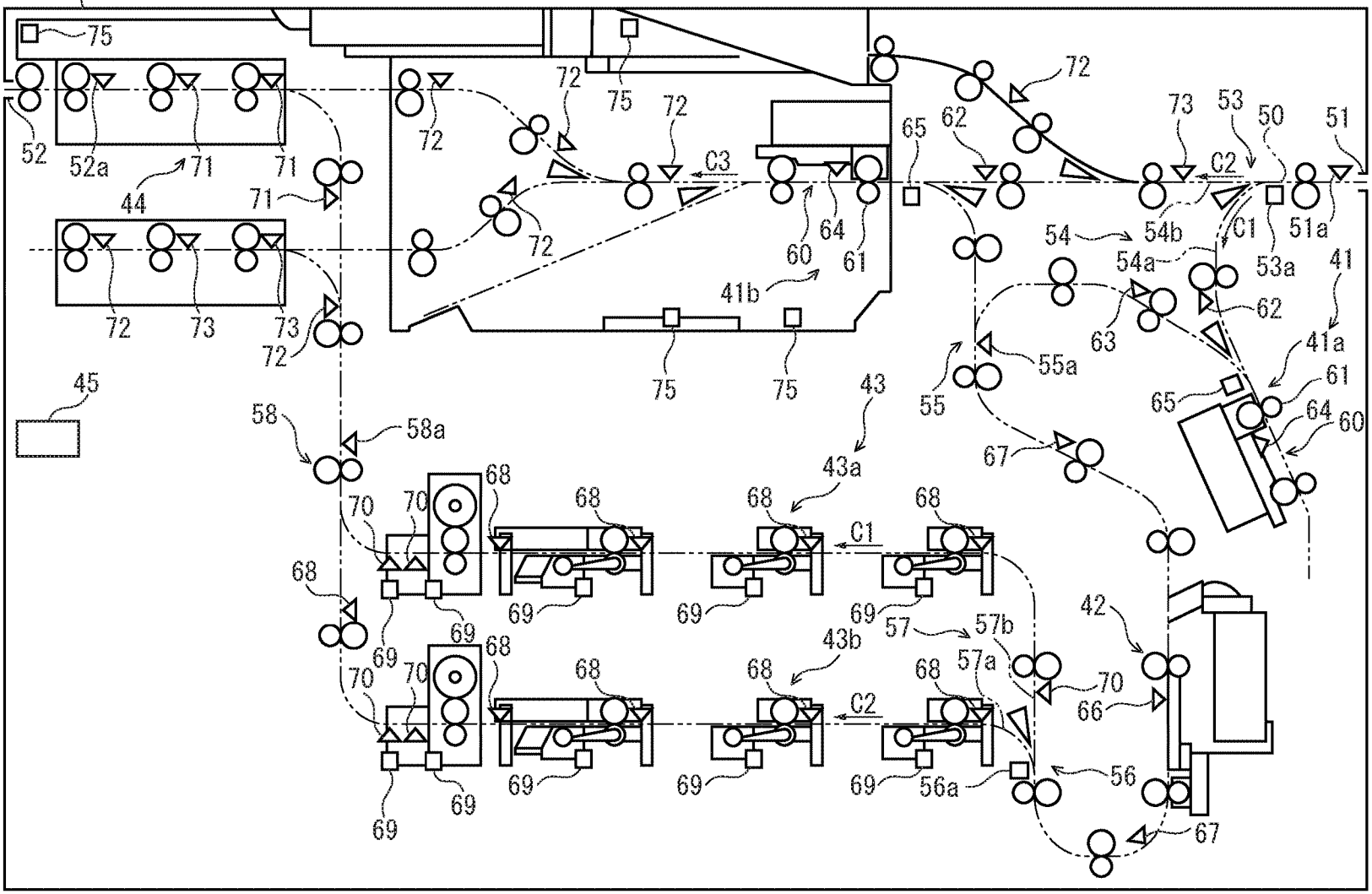
FIG. 2 is a sectional view schematically showing the relay conveyance device according to the embodiment of the present disclosure.

Structure of the relay conveyance device 4 will be described with reference to FIGS. 1 and 2. The relay conveyance device 4 is a separate body from the image forming apparatus 2 and the post processing device 3 and is removably attached to them.

The relay conveyance device 4 includes a housing 40, a plurality of reversing units 41 (a first reversing unit 41*a* and a second reversing unit 41*b*) housed in a right part and an upper part of the housing 40, a curl straightening unit 42 housed in a right lower part of the housing 40, a plurality of correcting units 43 (a first correcting unit 43*a* and a second correcting unit 43*b*) housed in a lower part of the housing 40, and an accelerating unit 44 housed in a left upper part of the housing 40.

Inside the housing 40, a relay conveyance path 50 conveying the sheet is provided. The relay conveyance path 50 is arranged along the plurality of reversing units 41, the curl straightening unit 42, the plurality of correcting units 43 and the accelerating unit 44 between the upstream side conveyance path 23 of the image forming apparatus 2 and the downstream side conveyance path 33 of the post processing device 3. Moreover, along the relay conveyance path 50, a plurality of pairs of rollers are provided, and the sheet introduced from the upstream side conveyance path 23 to the relay conveyance device 4 is conveyed along the relay conveyance path 50 and ejected to the downstream side conveyance path 33.

Moreover, the relay conveyance device 4 includes a second control device 45 controlling conveyance of the sheet on the relay conveyance path 50, operation of the plurality of reversing units 41, the curl straightening unit 42, the plurality of correcting units 43 and the accelerating unit 44.

At an upstream end of the relay conveyance path 50, a relay introducing port 51 is provided. The relay introducing port 51 is opened in an upper part of a right face of the housing 40 (a lateral face at a side of the image forming apparatus 2) and arranged to face to the upstream side ejecting port 24 of the image forming apparatus 2. In the vicinity of the relay introducing port 51, a pair of introducing rollers are provided, and the sheet ejected from the upstream side ejecting port 24 is introduced to the relay conveyance path 50 via the relay introducing port 51. Moreover, in the vicinity of the relay introducing port 51, a first sheet sensor 51*a* detecting the sheet introduced to the relay conveyance path 50 is provided, and the second control device 45 monitors detection result of the first sheet sensor 51*a*. The first sheet sensor 51*a* is also used as a sensor monitoring conveyance jam of the sheet introduced to the relay conveyance path 50.

At a downstream end of the relay conveyance path 50, a relay ejecting port 52 is provided. The relay ejecting port 52 is opened in an upper part of a left face of the housing 40 (a lateral face at a side of the post processing device 3) and arranged to face to the downstream side introducing port 34 of the post processing device 3. In the vicinity of the relay ejecting port 52, a pair of ejecting rollers are provided, and the sheet conveyed on the relay conveyance path 50 is ejected to the downstream side introducing port 34 via the relay ejecting port 52. Moreover, in the vicinity of the relay ejecting port 52, a second sheet sensor 52*a* detecting the sheet ejected from the relay conveyance path 50 is provided, and the second control device 45 monitors detection result of the second sheet sensor 52*a*. The second sheet sensor 52*a* is also used as a sensor monitoring conveyance jam of the sheet ejected from the relay conveyance path 50.

At an upstream part of the relay conveyance path 50, a first branch section 53 is provided and the relay conveyance path 50 branches off at the first branch section 53 into a plurality of reverse paths 54 (a first reverse path 54*a* and a second reverse path 54*b*). The first branch section 53 is configured to have, for example, a branching pawl. The sheet introduced from the relay introducing port 51 to the relay conveyance path 50 is conveyed to the first reverse path 54*a* or the second reverse path 54*b* by the first branch section 53 controlled by the second control device 45. In the vicinity of the first branch section 53, a first position sensor 53*a* detecting a home position (a top end position) of the sheet reaching the first branch section 53 is provided, and the second control device 45 monitors detection result of the first position sensor 53*a*.

At a downstream side from the first branch section 53 on the relay conveyance path 50, a first confluence section 55 is provided, and the first reverse path 54*a* and the second reverse path 54*b* join the relay conveyance path 50 at the first confluence section 55. In the vicinity of the first confluence section 55, a pair of confluence rollers are provided, and the sheet conveyed from the first reverse path 54*a* or the second reverse path 54*b* is conveyed to the first confluence section 55. Moreover, in the vicinity of the first confluence section 55, a third sheet sensor 55*a* detecting the sheet reaching the first confluence section 55 from the first reverse path 54*a* or the second reverse path 54*b* is provided, and the second control device 45 monitors detection result of the third sheet sensor 55*a*. The third sheet sensor 55*a* is also used as a sensor detecting accumulation jam of the sheet at the first confluence section 55.

At a downstream side (a middle-stream part) from the first confluence section 55 on the relay conveyance path 50, a second branch section 56 is provided, and the relay conveyance path 50 branches off at the second branch section 56 into a plurality of correction paths 57 (a first correction path 57*a* and a second correction path 57*b*). The second branch section 56 is configured to have, for example, a branching pawl. The sheet conveyed from the first confluence section 55 along the relay conveyance path 50 is conveyed to the first correction path 57*a* or the second correction path 57*b* by the second branch section 56 controlled by the second control device 45. In the vicinity of the second branch section 56, a second position sensor 56*a* detecting a home position (a top end position) of the sheet reaching the second branch section 56 is provided, and the second control device 45 monitors detection result of the second position sensor 56*a*.

At a downstream side from the second branch section 56 on the relay conveyance path 50, a second confluence section 58 is provided, and the first correction path 57*a* and the second correction path 57*b* join the relay conveyance path 50 at the second confluence section 58. In the vicinity of the second confluence section 58, a pair of confluence rollers are provided, and the sheet conveyed from the first correction path 57*a* or the second correction path 57*b* is conveyed to the second confluence section 58. Moreover, in the vicinity of the second confluence section 58, a fourth sheet sensor 58*a* detecting the sheet reaching the second confluence section 58 from the first correction path 57*a* or the second correction path 57*b* is provided, and the second control device 45 monitors detection result of the fourth sheet sensor 58*a*. The fourth sheet sensor 58*a* is also used as a sensor detecting accumulation jam of the sheet at the second confluence section 58.

In the relay conveyance path 50, a first conveyance path C1 from the relay introducing port 51 to the relay ejecting port 52 through the first reverse path 54*a* and the first correction path 57*a* and a second conveyance path C2 from the relay introducing port 51 to the relay ejecting port 52 through the second reverse path 54*b* and the second correction path 57*b* are set by the same length as each other.

Incidentally, in the relay conveyance path 50, an abbreviation path C3 conveying the sheet from the relay introducing port 51 to the accelerating unit 44 without passing through the plurality of reversing units 41, the curl straightening unit 42 and the plurality of correcting units 43 is provided. The abbreviation path C3 is arranged in the upper part of the housing 40 and is connected to the accelerating unit 44 with applying a part of the second reverse path 54*b*.

The first reversing unit 41*a* and the second reversing unit 41*b* are respectively arranged on the first reverse path 54*a* and the second reverse path 54*b*. Each of the first reversing unit 41*a* and the second reversing unit 41*b* includes a reverse area 60 and a pair of reversing rollers 61 arranged at an upstream side on the reverse area 60. When the sheet is conveyed from each of the first reverse path 54*a* and the second reverse path 54*b* to each of the first reversing unit 41*a* and the second reversing unit 41*b*, the pair of reversing rollers 61 are positively rotated to introduce the sheet to the reverse area 60. Each of the first reversing unit 41*a* and the second reversing unit 41*b* temporarily stops the sheet at the reverse area 60 for a predetermined time, and then, negatively rotates the pair of reversing rollers 61 to eject the sheet from the reverse area 60. At this time, a rear end of the sheet before reversing becomes a top end of the sheet ejected from the reverse area 60, that is, the top end and the rear end of the conveyed sheet are inverted.

In addition, on the first reverse path 54*a* and the second reverse path 54*b*, fifth sheet sensors 62 detecting the sheet introduced to the first reversing unit 41*a* and the second reversing unit 41*b*, and sixth sheet sensors 63 detecting the sheet ejected from the first reversing unit 41*a* and the second reversing unit 41*b* are respectively provided, and the second control device 45 monitors detection result of the fifth sheet sensors 62 and the sixth sheet sensors 63. The fifth sheet sensors 62 are also used as sensors monitoring conveyance jam of the sheet introduced to the first reversing unit 41*a* and the second reversing unit 41*b*. The sixth sheet sensors 63 are also used as sensors detecting accumulation jam of the sheet ejected from the first reversing unit 41*a* and the second reversing unit 41*b*.

In the first reversing unit 41*a* and the second reversing unit 41*b*, seventh sheet sensors 64 detecting the sheet introduced to the reverse area 60 are provided, and the second control device 45 monitors detection result of the seventh sheet sensors 64. The seventh sheet sensors 64 are also used as sensors monitoring conveyance jam of the sheet in the first reversing unit 41*a* and the second reversing unit 41*b*.

In the vicinity of the inlet/outlet port of the sheet in the first reversing unit 41*a* and the second reversing unit 41*b*, third position sensors 65 detecting a home position (a rear end position before reversing and a top end position after reversing) of the sheet introduced to/ejected from the reverse area 60 are provided, and the second control device 45 monitors detection result of the third position sensors 65.

The curl straightening unit 42 is arranged between the first confluence section 55 and the second branch section 56 on the relay conveyance path 50. That is, the curl straightening unit 42 is located at a downstream side from the first reversing unit 41*a* and the second reversing unit 41*b* on the relay conveyance path 50. For example, the curl straightening unit 42 pressures the sheet passing through the relay conveyance path 50 from both of a surface side and a back-face side by a pair of straightening rollers, thereby to straighten the curl caused in the sheet. Incidentally, in the curl straightening unit 42, an accumulation sensor 66 detecting accumulation jam of the sheet in curl straightening and a conveyance sensor 67 detecting conveyance jam of the sheet in curl straightening are provided.

The first correcting unit 43*a* and the second correcting unit 43*b* are arranged in the first correction path 57*a* and the second correction path 57*b*. That is, the first correcting unit 43*a* and the second correcting unit 43*b* are located at a downstream side from the curl straightening unit 42 on the relay conveyance path 50. For example, each of the first correcting unit 43*a* and the second correcting unit 43*b* includes a plurality of pairs of correcting rollers conveying the sheet on each of the first correction path 57*a* and the second correction path 57*b* to correct positions in forward and backward directions of the sheet by rotation and stop of each pair of the correcting rollers. Incidentally, in the first correcting unit 43*a* and the second correcting unit 43*b*, conveyance sensors 68 detecting conveyance jam of the sheet in position correcting, position sensors 69 detecting home positions (positions) of the sheet before and after correcting, and accumulation sensors 70 detecting accumulation jam of the sheet in position correcting are provided.

The accelerating unit 44 is arranged between the second confluence section 58 and the relay ejecting port 52 on the relay conveyance path 50. For example, the accelerating unit 44 includes a plurality of pairs of accelerating rollers. Each pair of accelerating rollers are arranged at an upstream side from the pair of ejecting rollers of the relay ejecting port 52 on the relay conveyance path 50. Each pair of accelerating rollers accelerate conveyance speed of the sheet to convey the sheet to the relay ejecting port 52. Incidentally, in the accelerating unit 44, accumulation sensors 71 detecting accumulation jam of the sheet in accelerating are provided.

Inside the housing 40 of the relay conveyance device 4, in addition to the above-described sensors, other conveyance sensors 72 monitoring conveyance jam of the sheet, other accumulation sensors 73 detecting accumulation jam of the sheet, and other position sensors detecting home positions (positions) of the sheet are provided at various positions on the relay conveyance path 50. Moreover, inside the housing 40 of the relay conveyance device 4, interlock switches 74 detecting attachment of various components, such as a cover removably attached to the relay conveyance device 4, are provided.

Next, the second control device 45 and its periphery will be described with reference to FIG. 3. The second control device 45 is composed of a controlling part, such as a central processing unit (CPU), and storages, such as a read only memory (ROM) and a random access memory (RAM). The second control device 45 is configured so that the controlling part controls each component connected to the second control device 45 on the basis of control programs and control data stored in the storages.

The second control device 45 is connected to a second communicating part 46, and the second communicating part 46 is communicably connected to the first communicating part 26 of the image forming apparatus 2 and the post processing device 3. The second control device 45 receives the sheet information, such as a size, a type and others, of the sheet introduced from the image forming apparatus 2 to the relay conveyance device 4 via the second communicating part 46 from the image forming apparatus 2.

In the storages of the second control device 45, for example, initial values (e.g. 50 msec) of stop times of the sheet in the first reversing unit 41*a* and the second reversing unit 41*b* and correction values (a first correction value and a second correction value) used for correcting the stop times, and others are stored. Incidentally, the first correction value and the second correction value for the stop times are stored for each sheet condition composed of a combination of the size, the type and others of the sheet.

The second control device 45 is connected to, for example, as shown in FIG. 3, the seventh sheet sensors 64 in the first reversing unit 41*a* and the second reversing unit 41*b* and the third sheet sensor 55*a* in the first confluence section 55 to monitor detection results of these sheet sensors.

Incidentally, although illustration is omitted, the second control device 45 is connected to the first sheet sensor 51*a*, the second sheet sensor 52*a*, the fourth sheet sensor 58*a*, the fifth sheet sensors 62, the sixth sheet sensors 63, the first position sensor 53*a*, the second position sensor 56*a* and the third position sensor 65*s* as described above to monitor detection results of these sheet sensors. Moreover, although illustration is omitted, the second control device 45 is connected to the accumulation sensor 66, the conveyance sensor 67, the conveyance sensors 68, the position sensors 69, the accumulation sensors 70, the accumulation sensors 71, the conveyance sensors 72, the accumulation sensors 73, other position sensors and interlock switches 74 as described above to monitor detection results of the sensors and the switches.

Further, the second control device 45 is connected to a driving part 47 driving and rotating the above-described pairs of rollers (the pair of introducing rollers, the pair of ejecting rollers, the pair of confluence rollers, the pair of reversing rollers, the pair of straightening rollers, the pairs of correcting rollers, the pairs of accelerating rollers, and other conveying rollers) along the relay conveyance path 50. The second control device 45 controls the driving part 47 to rotate each pair of rollers, and thereby to convey the sheet.

Particularly, the second control device 45 adjusts rotation drive force of the driving part 47 for each pair of rollers, and thereby, can control conveyance speed of the sheet. Incidentally, since the accelerating unit 44 (the pairs of accelerating rollers) accelerates the conveyance speed of the sheet faster than other portions of the relay conveyance path 50, another exclusive driving part different from the driving part 47 may be provided for the accelerating unit 44.

Moreover, the second control device 45 is connected to the first branch section 53 and the second branch section 56. The second control device 45 controls to the first branch section 53 and the second branch section 56 to switch a conveyance path for each sheet between the first conveyance path C1 through the first reverse path 54*a* and the first correction path 57*a* and the second conveyance path C2 through the second reverse path 54*b* and the second correction path 57*b*.

Next, conveyance operation of the sheet in the first reverse path 54*a* and the second reverse path 54*b* controlled by the second control device 45 will be described.

The relay conveyance device 4 controls each component so as to treat the sheet continuously introduced from the image forming apparatus 2 by predetermined treatment capacity (e.g. 60-100 sheets per minute) and to convey the sheet to the post processing device 3. In order to improve the treatment capacity, it is necessary to set the conveyance speed of the sheet by as fast speed as possible, that is, to shorten interval time (interval distance) between the sheets. Incidentally, in the first reversing unit 41*a* and the second reversing unit 41*b*, if the interval time is too short, the sheet to be reversed may interfere with the following sheet. Therefore, in the first reversing unit 41*a* and the second reversing unit 41*b*, it is necessary to sufficiently lengthen the interval time so that the continuous sheets do not interfere with each other.

In the embodiment, the sheet reaching the first branch section 53 is conveyed one by one while alternately switching the first reverse path 54*a* and the second reverse path 54*b*, and then, reverse process is carried out while alternately using the first reversing unit 41*a* and the second reversing unit 41*b*. Therefore, if the interval times between the sheets conveyed at an upstream side and a downstream side from the first reverse path 54*a* and the second reverse path 54*b* are short, it is possible to sufficiently lengthen the interval times between the sheets conveyed in the first reverse path 54*a* and the second reverse path 54*b*.

Further, the second control device 45 of the embodiment monitors the third sheet sensor 55*a* of the first confluence section 55 at the downstream side from the first reverse path 54*a* and the second reverse path 54*b*, and measures the interval time between the sheets passing through the first confluence section 55 on the basis of detection result of the third sheet sensor 55*a*. Here, the interval time from detection of the rear end of the sheet conveyed from the second reverse path 54*b* by the third sheet sensor 55*a* to detection of the top end of the following sheet conveyed from the first reverse path 54*a* by the third sheet sensor 55*a* is called as a first interval time of the first reverse path 54*a*. Moreover, the interval time from detection of the rear end of the sheet conveyed from the first reverse path 54*a* by the third sheet sensor 55*a* to detection of the top end of the following sheet conveyed from the second reverse path 54*b* by the third sheet sensor 55*a* is called as a second interval time of the second reverse path 54*b*.

The second control device 45 measures the first interval time of the first reverse path 54*a* and, whenever the first interval times of a predetermined number of measurement (e.g. three times) are measured, calculates an average time (a first average time) of the first interval times of the predetermined number of measurement. Moreover, the second control device 45 measures the second interval time of the second reverse path 54*b* and, whenever the second interval times of a predetermined number of measurement are measured, calculates an average time (a second average time) of the second interval times of the predetermined number of measurement.

Subsequently, the second control device 45 compares the first average time and the second average time. If the first average time is longer than the second average time or if a difference obtained by subtract the second average time from the first average time exceeds a predetermined error range (e.g. 10 msec), the second control device 45 decides that the malfunction, such as sheet slip, occurs in the first reverse path 54*a*. In such a case, the second control device 45 adds the difference obtained by subtract the second average time from the first average time into the second correction value of the stop time of the second reversing unit 41*b*. The second correction value as an added object is a second correction value corresponding to sheet condition of the sheet passed through the first confluence section 55 in calculating the second average time. Incidentally, an initial value of the second correction value is set to zero, and the second correction value is updated by adding-up for each sheet condition and accumulated.

Figure 4:
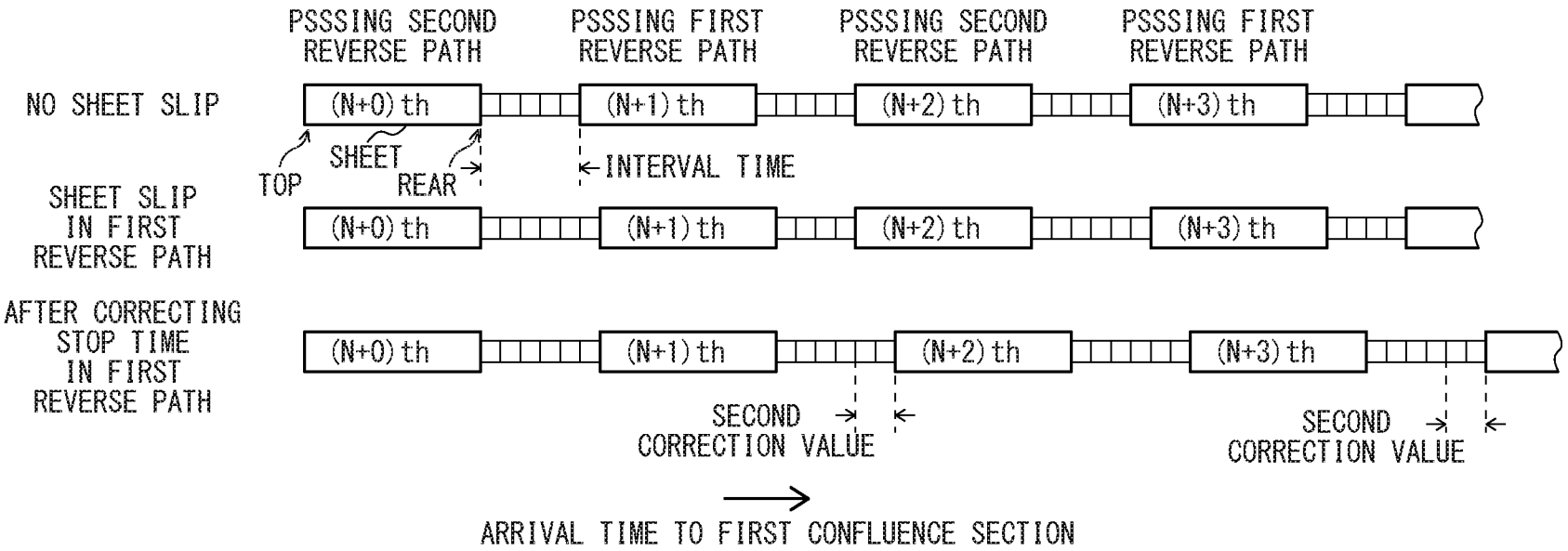
FIG. 4 is an explanatory diagram showing conveyance operation of sheets in the reverse paths in the relay conveyance device according to the embodiment of the present disclosure.

For example, in FIG. 4, relationship of time when the sheets are continuously conveyed while alternately switching the first reverse path 54*a* and the second reverse path 54*b* to reach the first confluence section 55 is schematically illustrated. Incidentally, description of averaging of the interval time is omitted. Here, in a case where sheet slip does not occur, time until the sheet passed through the first reverse path 54*a* reaches the first confluence section 55 is equal to time until the sheet passed through the second reverse path 54*b* reaches the first confluence section 55. Subsequently, if sheet slip occurs in the first reverse path 54*a*, the conveyance speed of the sheet is decelerated, and therefore, the interval time of the sheet passed through the first reverse path 54*a* becomes longer than interval time of the sheet passed through the second reverse path 54*b*. Thereupon, the stop time of the second reversing unit 41*b* is corrected by using a difference between these interval times as the second correction value, and accordingly, the sheet passing through the second reverse path 54*b* stops by the second correction value in surplus, and therefore, the interval times of the first reverse path 54*a* and the second reverse path 54*b* are equal to each other.

After that, in a case where the second control device 45 temporarily stops the sheet in the second reversing unit 41*b* on the basis of the detection result of the seventh sheet sensor 64 in the second reversing unit 41*b*, the second control device 45 temporarily stops the sheet for a time corrected by adding the second correction value to the stop time. Thereby, since the stop time of the sheet in the second reversing unit 41*b* is lengthened by the difference between the first average time and the second average time, the second interval time of the second reverse path 54*b* is lengthened so as to match with the first interval time of the first reverse path 54*a*.

On the other hand, if the second average time is longer than the first average time or if a difference obtained by subtract the first average time from the second average time exceeds the predetermined error range, the second control device 45 decides that the malfunction, such as sheet slip, occurs in the second reverse path 54*b*. In such a case, the second control device 45 adds the difference obtained by subtract the first average time from the second average time into the first correction value of the stop time of the first reversing unit 41*a*. The first correction value as an added object is a first correction value corresponding to sheet condition of the sheet passed through the first confluence section 55 in calculating the first average time. Incidentally, an initial value of the first correction value is set to zero, and the first correction value is updated by adding-up for each sheet condition and accumulated.

After that, in a case where the second control device 45 temporarily stops the sheet in the first reversing unit 41*a* on the basis of the detection result of the seventh sheet sensor 64 in the first reversing unit 41*a*, the second control device 45 temporarily stops the sheet for a time corrected by adding the second correction value to the stop time. Thereby, since the stop time of the sheet in the first reversing unit 41*a* is lengthened by the difference between the first average time and the second average time, the first interval time of the first reversing unit 41*a* is lengthened so as to match with the second interval time of the second reverse path 54*b*.

Further, the second control device 45 decides whether or not the first correction value and the second correction value reach a predetermined maximum correction value. Subsequently, if the first correction value or the second correction value reaches the predetermined maximum correction value, the second control device 45 announces an error by using a display (not shown) or a speaker (not shown) provided in the relay conveyance device 4, or transmits an error to the image forming apparatus 2 via the second communicating part 46 to announce an error by using a display (not shown) or a speaker (not shown) provided in the image forming apparatus 2. At this time, in error announcing, an indication or an alarm is outputted to encourage maintenance of the first reverse path 54*a* or the second reverse path 54*b*, or the first reversing unit 41*a* or the second reversing unit 41*b*.

Incidentally, the second control device 45 can decide which of the first correction value and the second correction value reaches the maximum correction value, and thereby, on the basis of decision result, decide which of the first reverse path 54*a* and the second reverse path 54*b* (the first reversing unit 41*a* and the second reversing unit 41*b*) has malfunction. Therefore, in error announcing, it is possible to identify the first reverse path 54*a* and the second reverse path 54*b* (the first reversing unit 41*a* and the second reversing unit 41*b*) having malfunction to output the indication or the alarm encouraging maintenance.

Further, during the first correction value or the second correction value reaches the maximum correction value and the error occurs, the second control device 45 controls the driving part 47 to decelerate the conveyance speed of the sheet on the relay conveyance path 50. For example, when the normal conveyance speed during the error does not occur is set to the treatment capacity of 60 sheets per minute, the conveyance speed during the error occurs is decelerated to the treatment capacity of 50 sheets per minute.

Incidentally, after maintenance of the first reverse path 54*a* and the second reverse path 54*b* is completed, the first correction value or the second correction value is reset (set to zero), and the conveyance speed of the sheet on the relay conveyance path 50 is returned to the normal conveyance speed.

In accordance with the embodiment, as described above, the relay conveyance device 4 includes the relay conveyance path 50, at least two reversing units 41, and the second control device 45. The relay conveyance path 50 is arranged between the image forming apparatus 2 forming the image on the sheet and the post processing device 3 carrying out post process to the sheet with the image formed by the image forming apparatus 2 to convey the sheet from the image forming apparatus 2 to the post processing device 3. The reversing units 41 reverse the surface side and the back-face side of the sheet. The second control device 45 controls conveyance of the sheet on the relay conveyance path 50. The relay conveyance path 50 includes at least two reverse paths 54 respectively passing through the at least two reversing units 41, the first branch section 53 branching into the at least two reverse paths 54 at the upstream side, and the first confluence section 55 joining the at least two reverse paths 54. The second control device 45 controls the first branch section 53 and the first confluence section 55 to convey the sheet while alternately switching the at least two reverse paths 54, measures the interval time between the sheets passing through the first confluence section 55, and controls conveyance of the sheet in the at least two reverse paths 54 so as to uniformize the interval time.

According to such a configuration, if malfunction, such as sheet slip, occurs in one reverse path 54 of the at least two reverse paths 54, the interval time between the sheets passed through the at least two reverse paths 54 is corrected so as to be uniform. Therefore, it is possible to stabilize the interval between the sheets conveyed in the relay conveyance device 4 and to stabilize conveyance and process in the relay conveyance device 4 and the following post processing device 3.

Moreover, in the embodiment, the at least two reverse paths 54 are configured so as to stop the sheet for a predetermined stop time, when a first interval time of the sheet passing through the one reverse path 54 is longer than a second interval time of the sheet passing through the other reverse path 54, the second control device 45 corrects the stop time of the reversing unit 41 in the other reverse path 54 by using a difference between the first interval time and the second interval time as a correction value of the other reverse path 54. Thereby, the interval time between the sheets passed through the at least two reverse paths 54 is corrected so as to be uniform more accurately.

In addition, in the embodiment, the second control device 45 accumulates the correction value updated by adding-up, and announces an error when the correction value reaches a predetermined maximum correction value. Thereby, if the interval time before correction become too long due to malfunction, such as sheet slip, on the reverse paths 54, it is possible to announce the error to a user so as to encourage maintenance or the like.

Further, in the embodiment, the second control device 45 accumulates the correction value updated by adding-up for each sheet condition, such as the size, the type and others of the sheet. Thereby, even if malfunction, such as sheet slip, on the reverse paths 54 is varied in accordance with the sheet condition, it is possible to correct the interval time between sheets passed through the reverse paths 54 in accordance with malfunction for each sheet condition.

Furthermore, in the embodiment, the second control device 45 decelerates the conveyance speed of the sheet conveyed on the relay conveyance path 50, when the correction value of the other reverse path 54 reaches the maximum correction value. Thereby, if the interval time before correction become too long due to malfunction, such as sheet slip, on the reverse paths 54, it is possible to restrain malfunction, such as sheet slip, by decelerating the conveyance speed and to continue conveyance and process of the sheet in the relay conveyance device 4.

Incidentally, in the above-described embodiment, an example was described, in this example, when the correction value of the reverse path 54 reaches the maximum correction value and the error occurs was described, the conveyance speed of the sheet conveyed on the relay conveyance path 50 is decelerated. However, the present disclosure is not restricted by this example. In a different embodiment, the second control device 45 decides which of the correction values of the at least two reverse paths 54 reaches the maximum correction value, and decides which of the at least two reverse paths 54 has malfunction. Subsequently, the second control device 45 controls to stop use of the reverse path 54 having malfunction, and to continuously use the reverse path 54 having no malfunction to convey the sheet. Thereby, in the different embodiment, if the interval time before correction become too long due to malfunction, such as sheet slip, on the reverse paths 54, it is possible to continue conveyance and process of the sheet in the relay conveyance device 4. Incidentally, if the two reverse paths 54 (the first reverse path 54*a* and the second reverse path 54*b*) are controlled to use only the reverse path 54 having no malfunction, it is not necessary to decelerate the conveyance speed of the using reverse path 54, but the conveyance speed on the relay conveyance path 50 is controlled to be in half.

Although the embodiments was described as example about a case applying the relay conveyance device 4 of the present disclosure to the image forming system 1 including the ink-jet type image forming apparatus 2, the disclosure is not restricted by this example, and the disclosure may be applied to, for example, another image forming system including another image forming apparatus.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A relay conveyance device comprising:

a relay conveyance path being arranged between an image forming apparatus forming an image on a sheet and a post processing device carrying out post process to the sheet with the image formed by the image forming apparatus to convey the sheet from the image forming apparatus to the post processing device;

at least two reversing units reversing a surface side and a back-face side of the sheet; and a control device controlling conveyance of the sheet on the relay conveyance path, wherein the relay conveyance path includes:

at least two reverse paths respectively passing through the at least two reversing units;

a branch section branching into the at least two reverse paths at an upstream side; and a confluence section joining the at least two reverse paths, the control device controls the branch section and the confluence section to convey the sheet while alternately switching the at least two reverse paths, measures an interval time between the sheets passing through the confluence section, and controls conveyance of the sheet in the at least two reverse paths so as to uniformize the interval time, the at least two reverse units are configured so as to stop the sheet for a predetermined stop time, the control device measures a first interval time of the sheet passing through one reverse path and the confluence section, and measures a second interval time of the sheet passing through the other reverse path and the confluence section, the control device further calculates a first average time by averaging first interval times of a predetermined number of measurement whenever the first interval times of the predetermined number of measurement are measured, and calculates a second average time by averaging second interval times of the predetermined number of measurement whenever the second interval times of the predetermined number of measurement are measured, and when the first averaging time is longer than the second averaging time, the control device corrects the stop time of the reversing unit in the other reverse path by using a difference between the first averaging time and the second averaging time as a correction value of the other reverse path.

2. The relay conveyance device according to claim 1, wherein the control device decelerates conveyance speed of the sheet conveyed on the relay conveyance path, when the correction value of the other reverse path reaches a predetermined maximum correction value.

3. The relay conveyance device according to claim 1, wherein when the correction value of the other reverse path reaches a predetermined maximum correction value, the control device controls to stop use of the other reverse path, and to continuously use one reverse path to convey the sheet.

4. The relay conveyance device according to claim 2, wherein after maintenance of the other reverse path is completed, the correction value is reset and the control device returns the conveyance speed of the sheet conveyed on the relay conveyance path to normal conveyance speed.

* * * * *